United States Patent [19]

Lin et al.

[11] Patent Number: 4,563,408

[45] Date of Patent: Jan. 7, 1986

[54] PHOTOCONDUCTIVE IMAGING MEMBER WITH HYDROXYAROMATIC ANTIOXIDANT

[75] Inventors: John W. P. Lin; Lesley P. Dudek, both of Webster; William W. Limburg, Penfield; Eric J. Schneider, Webster, all of N.Y.

[73] Assignee: Xerox Corporation, Stamford, Conn.

[21] Appl. No.: 686,045

[22] Filed: Dec. 24, 1984

[51] Int. Cl.[4] ..... G03G 5/14

[52] U.S. Cl. ..... 430/59

[58] Field of Search ..... 430/59

[56] References Cited

U.S. PATENT DOCUMENTS

| | | | |
|---|---|---|---|
| 3,951,654 | 4/1976 | Mammino | 96/1.6 |
| 4,082,550 | 4/1978 | Yoerger | 96/1.5 R |
| 4,152,152 | 5/1979 | Contois et al. | 96/1.6 |
| 4,191,568 | 3/1980 | Ema et al. | 430/66 |
| 4,232,103 | 11/1980 | Limburg et al. | 430/59 |
| 4,256,821 | 3/1981 | Enomoto et al. | 430/59 |
| 4,265,990 | 5/1981 | Stolka et al. | 430/59 |
| 4,291,110 | 9/1981 | Lee | 430/59 |
| 4,361,637 | 11/1982 | Stofko, Jr. et al. | 430/58 |
| 4,365,014 | 12/1982 | Sakai et al. | 430/59 |
| 4,388,392 | 6/1983 | Kato et al. | 430/58 |
| 4,390,609 | 6/1983 | Wiedemann | 430/58 |
| 4,397,931 | 8/1983 | Limburg et al. | 430/59 |
| 4,439,507 | 3/1984 | Pan et al. | 430/59 |
| 4,454,212 | 6/1984 | Sakai et al. | 430/59 |
| 4,456,672 | 6/1984 | Eilingsfeld et al. | 430/59 |
| 4,457,994 | 7/1984 | Pai et al. | 430/59 |
| 4,464,450 | 8/1984 | Teuscher | 430/59 |

FOREIGN PATENT DOCUMENTS

| | | |
|---|---|---|
| 2059617 | 4/1981 | United Kingdom . |

*Primary Examiner*—Roland E. Martin

*Attorney, Agent, or Firm*—Peter H. Kondo

[57] ABSTRACT

An electrophotographic imaging member is disclosed comprising a conductive layer, a charge transport layer comprising an aromatic amine charge transport or hydrazone molecule in a continuous polymeric binder phase, and a contiguous charge generation layer comprising a photoconductive material, a polymeric binder and a hydroxyaromatic antioxidant. An electrophotographic imaging process using this member is also described.

13 Claims, No Drawings

PHOTOCONDUCTIVE IMAGING MEMBER WITH HYDROXYAROMATIC ANTIOXIDANT

BACKGROUND OF THE INVENTION

This invention relates in general to electrophotography and, more specifically, to a novel electrophotographic imaging member and process for using the imaging member.

In the art of electrophotography, an electrophotographic imaging member containing a photoconductive layer is imaged by first uniformly electrostatically charging the imaging surface of the imaging member. The member is then exposed to a pattern of activating electromagnetic radiation such as light which selectively dissipates the charge in the illuminated areas of the photoconductive layer while leaving behind an electrostatic latent image in the non-illuminated areas. The electrostatic latent image may then be developed to form a visible image by depositing finely divided properly charged toner particles on the surface of the photoconductive layer to form a toner image which is thereafter transferred to a receiving member and fixed thereto.

A photoconductive layer for use in xerography may be a homogeneous layer of a single material such as vitreous selenium or it may be a composite of layers containing a photoconductor and another material. One type of composite photoconductive photoreceptor used in xerography is illustrated in U.S. Pat. No. 4,265,990 which describes a photosensitive member having at least two elecrically operative layers. One layer comprises a photoconductive layer which is capable of photogenerating holes and injecting the photogenerated holes into a contiguous charge transport layer. Such a photoconductive layer is often referred to as a charge generating or photogenerating layer. Generally, where the two electrically operative layers are supported on a conductive layer with the photoconductive layer capable of photogenerating holes and injecting photogenerated holes sandwiched between the contiguous charge transport layer and the supporting conductive layer, the outer surface of the charge transport layer is normally charged with uniform charges of a negative polarity and the supporting electrode is utilized as an anode. Obviously, the supporting electrode may function as a cathode when the charge transport layer is sandwiched between the electrode and a photoconductive layer which is capable of photogenerating holes and electrons and injecting the photogenerated holes into a charge transport layer when the outer surface of the photoconductive layer is charged with uniform charges of a positive polarity.

Other types of composite photoconductor employed in xerography include photoresponsive devices in which a conductive substrate or electrode is coated with optional blocking and/or adhesive layers, a charge transport layer such as a hole transport layer, and a photoconductive layer. Where the transport layer is a hole transport layer, the outer surface of the photoconductive layer is charged positively. These types of composite photoconductors are described, for example, in copending applications U.S. Ser. No. 613,137, filed on May 23, 1984, entitled "Silylated Compositions and Deuterated Hydroxyl Squaraine Compositions and Processes" and U.S. Ser. No. 487,935, filed on Apr. 25, 1983, entitled "Overcoated Photoresponsive Devices", the entire disclosures thereof being incorporated herein in their entirety.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical inorganic photoconductive materials utilized in the charge generating layer include amorphous selenium, trigonal selenium, and selenium alloys such as selenium-tellurium, selenium-tellurium-arsenic, selenium-arsenic, and mixtures thereof. The organic photoconductive materials utilized in the charge generating layer include metal free phthalocyanines, vanadyl phthalocyanines, substituted and unsubstituted squaraine compounds, thiopyrylium compounds and azo and diazo dyes and pigments. The charge generation layer may comprise a homogeneous photoconductive material or particulate photoconductive material dispersed in a binder. Some examples of homogeneous and binder charge generation layer are disclosed in U.S. Pat. No. 4,265,990, the disclosure of this patent being incorporated herein in its entirety.

Organic photoreceptors can comprise either a single layer or a multilayer structure. The commonly used multilayered or composite structure contains at least a photogeneration layer, a charge transport layer and a conductive substrate. The photogeneration layer generally contains a photoconductive pigment and a polymeric binder. The charge transport layer (e.g. hole transport layer) contains a polymeric binder and charge transport molecules (e.g., aromatic amines, hydrazone derivatives, etc.). These organic, low ionization potential hole transport molecules as well as the polymeric binders are very sensitive to oxidative conditions arising from photochemical, electrochemical and chemical reactions. In copiers, duplicators and electronic printers they are frequently exposed to hazardous environmental conditions which include light, charging devices such as corotrons, dicorotrons, scorotrons and the like, electric fields, oxygen, oxidants and moisture. Undesirable chemical species are often formed during fabrication or during use in imaging processes which may react with key organic components in the charge transport layer or photogeneration layer of the photoreceptors. These unwanted chemical reactions can cause photoreceptor degradation, poor charge acceptance and cyclic instability.

Several types of reactive chemical species that are likely to be formed in the operational environment of a copier or an electronic printer include:

(a) Oxidants (e.g. peroxides, hydroperoxides, ozone, oxygen, selenium, selenium oxide, selenium alloys, arsenic oxide, vanadium oxide, VOPc, and the like) may vary depending on the type of photoreceptor used.

(b) Both organic and inorganic radicals and diradicals (e.g. $R^{\cdot}$, $RO_2^{\cdot}$, $O_2^{\cdot}$, $NO_2^{\cdot}$, $OH^{\cdot}$, and the like.).

(c) Ionic species having positive (e.g. aromatic amine$+^{\cdot}$) or negative (e.g. $O^-$) charges.

(d) Both singlet oxygen states (i.e. $^1O_2$ (Sigma+g) and $^1O_2$ ($\Delta$g) can form through a sensitized photooxidation mechanism.

The foregoing chemical species can be generated from chemical, electrochemical and photochemical reactions as well as from the corona discharge in air by a charging device. The oxidative intermediates and their products usually degrade the photoreceptor and lead to various electrical problems. If the entire photoreceptor degrades as a result of chemical and photchemical reactions, the photoreceptor becomes conductive (e.g. develops high dark decay) and exhibits poor charge acceptance, aging and stability deficiencies. Depending on the degree of damage, the photoreceptor degradation can lead to poor image quality, cycle-up, and cycle-down problems or even an inability of a copier or an electronic printer to produce a print.

Photosensitive members having at least two electrically operative layers as disclosed above in, for example, U.S. Pat. No. 4,265,990 and copending applications U.S. Ser. No. 613,137, filed on May 23, 1984, entitled "Silylated Compositions and Deuterated Hydroxyl Squaraine Compositions and Processes" and U.S. Ser. No. 487,935, filed on Apr. 25, 1983, entitled "Overcoated Photoresponsive Devices", provide excellent images when charged with a uniform electrostatic charge, exposed to a light image and thereafter developed with finely divided toner particles. However, when the charge transport layer comprises a film forming resin and one or more of certain aromatic amines, diamines and hydrazone compounds, difficulties have been encountered with these photosensitive members when they are used under certain conditions in copiers, duplicators and printers. For example, one undesirable effect occurs when the use of corona devices causes an increased degradation rate of the photoreceptor or when the photosensitive members are exposed to ultraviolet (U.V.) radiation. In other words, the charge acceptance capability of the photosensitive member decreases upon exposure to U.V. radiation or in the presence of free radicals. Moreover, multilayered photoreceptor devices utilizing either a transport layer sandwiched between a conductive layer and a photogeneration layer or a photogeneration layer sandwiched between a conductive layer and transport layer exhibit an increased dark decay rate under the adverse influence of corona charging devices. Dark decay is defined as the loss of charge on a photoreceptor in the dark after uniform charging. This is an undesirable fatigue-like problem resulting in lower initial charges and contrast potential that cannot be properly maintained during image cycling and is unacceptable for automatic electrophotographic copiers, duplicators and printers which require precise, stable, and a predictable photoreceptor operating range. More specifically, such devices generally experience low charge acceptance rates in the first few imaging cycles. The charge acceptance level gradually increases (cycle-up) upon cycling and eventually reaches an almost constant value. The poor initial charge acceptance of a photoreceptor causes poor image quality, light image density, poor solid area density or image deletion in the first few xerographic copies. This problem becomes more serious if the photoreceptor has been used for some time and dark-rested for several hours (e.g. overnight). For example, the charge acceptance level after dark-resting for photoreceptors containing vanadyl phthalocyanine in the charge generating layer (often referred to as a photogenerating or photoconductive layer) is normally lower than it normally would be under conditions where it has not dark-rested for several hours. This problem also occurs in other photoreceptors not containing vanadyl phthalocyanine and causes poor image quality of a printed copy and is considered a long-term cycle induced reduction of charge acceptance. If machine adjustments to compensate for these changing properties are made, copies made layer during cycling exhibit high background and poor images. The severity of the problem appears to be proportional to the number of copies made immediately preceeding shut down and also to the length of time the system is allowed to remain at rest. In the worst situation, the photoreceptor cannot be charged at all and is totally useless.

Thus, the characteristics of photosensitive members comprising a conductive layer and at least two electrically operative layers, one of which is a charge transport layer comprising a film forming resin and one or more aromatic amine compounds or hydrazone derivatives, exhibit deficiencies which are undesirable in modern copiers, duplicators, and printers. Accordingly, there is a need for compositions and processes which impart greater stability to electrophotographic imaging systems which undergo periodic cycling.

SUMMARY OF THE INVENTION

It is an object of the invention to provide an imaging member having at least two electrically operative layers, including a charge transport layer comprising an aromatic amine charge transport or hydrazone molecule in a continuous polymeric binder phase and a contiguous charge generation layer comprising a photoconductive material, a polymeric binder and a hydroxyaromatic antioxidant.

The hydroxyaromatic antioxidant may comprise a compound having the structural formula

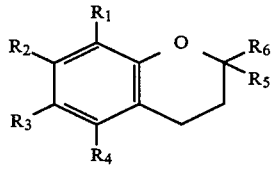

wherein $R_1$, $R_2$, $R_3$, and $R_4$ are independently selected from hydrogen, a hydroxyl group, an alkoxy group containing 1 to 6 carbon atoms, and an alkyl group containing 1 to 6 carbon atoms, wherein at least one of said $R_1$, $R_2$, $R_3$, and $R_4$ is a hydroxyl group, and $R_5$ and $R_6$ are independently selected from hydrogen, an alkenyl group containing 2 to 40 carbon atoms, methyl groups, and an alkyl group containing 1 to 40 carbon atoms.

Moreover, the hydroxyaromatic antioxidant may comprise a compound having the structural formula

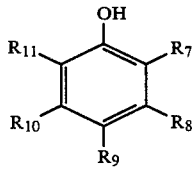

wherein $R_7$, $R_8$, $R_9$, $R_{11}$ and $R_{10}$ are independently selected from hydrogen, a linear alkyl group containing 1 to 20 carbon atoms, a branched alkyl group containing 1 to 20 carbon atoms, an unsubstituted phenyl group, a substituted phenyl group, a napthyl group, an ester group, and an alkoxy group containing 1 to 20 carbon atoms.

If desired, the hydroxyaromatic compound may be selected from the group consisting of unsubstituted napthol compounds and substituted napthol compounds.

These hydroxyaromatic antioxidant compounds prevent or minimize autooxidation and photooxidation.

Generally, an electrophotoconductive member containing an antioxidant compound of this invention comprises two electrically operative layers on a supporting substrate. This composite type electrophotoconductive member includes photoresponsive devices in which a conductive substrate or electrode is coated in sequence with optional blocking and/or adhesive layers, a charge transport layer such as a hole transport layer, a photoconductive layer, and an optional overcoating layer. Another type of composite electrophotoconductive member includes photoresponsive devices in which a conductive substrate or electrode is coated in sequence with optional blocking and/or adhesive layers, a photoconductive layer, a charge transport layer, and an optional overcoating layer.

In one embodiment, the layered photoresponsive device may comprise in the following sequence an electrically conductive substrate, an optional blocking layer, an optional adhesive layer, a photogenerating layer prepared in accordance with the present invention, a charge transport layer, and an optional overcoating layer. In another embodiment, the photoresponsive device comprises in the following sequence an electrically conductive substrate, an optional blocking layer, an optional adhesive layer, a transport layer, a charge generating layer prepared in accordance with the present invention, and an optional overcoating layer. In still another embodiment, photoresponsive devices useful in imaging systems may comprise in the following sequence an electrically conductive substrate, an optional blocking layer, an optional adhesive layer, a charge generating layer, another charge generating layer prepared in accordance with the present invention, a charge transport layer, and an optional overcoating layer.

In one preferred embodiment, the present invention is directed to an improved photoresponsive device comprising in sequence (1) a substrate, (2) a hole transport layer, (3) a photogenerating layer prepared in accordance with the present invention, and (4) a protective overcoating layer. A further important embodiment of the present invention resides in an improved photoresponsive device comprising in sequence (1) a conductive substrate, (2) a hole transport layer comprised of certain diamines dispersed in an inactive resinous binder composition, (3) a photogenerating layer prepared in accordance with the present invention comprising a chemical additive optionally dispersed in a resinous binder, and (4) a protective overcoating layer comprised of the alloys of selenium. If desired, optional adhesive and/or blocking layers may be interposed between the conductive substrate and a charge transport layer or between the conductive substrate and a photogenerating layer and an optional overcoating may be used on the outer imaging surface. These photoresponsive devices can be employed in copiers, duplicators and printing system. These copiers, duplicators and printing system utilizing various exposure means such as a laser, e.g. a gallium arsenide laser, or image bars for generating the image to be developed.

The substrate may be opaque or substantially transparent and may comprise numerous suitable materials having the required mechanical properties. A conductive layer or ground plane which may comprise the entire supporting substrate or be present as a coating or an underlying member (e.g. inorganic materials such as metals or organic materials such as polymeric films) may comprise any suitable material including, for example, aluminum, titanium, nickel, chromium, brass, gold, stainless steel, carbon black, graphite and the like. The conductive layer may vary in thickness over substantially wide ranges depending on the desired use of the electrophotoconductive member. Accordingly, the conductive layer can generally range in thickness of from about 50 Angstroms to many centimeters. When a flexible photoresponsive imaging device is desired, the thickness may be between about 100 Angstroms to about 5,000 Angstroms. The underlying member may be of any conventional material including metal, plastics and the like. Typical underlying members include insulating non-conducting materials comprising various resins known for this purpose including polyesters, polycarbonates, polyamides, polyurethanes, and the like. The coated or uncoated supporting substrate may be flexible or rigid and may have any number of many different configurations such as, for example, a plate, a cylindrical drum, a scroll, a film, an endless flexible belt, and the like. Preferably, the insulating substrate is in the form of an endless flexible belt and comprises a commercially available polyethylene terephthalate polyester known as Mylar available from E. I. du Pont de Nemours & Co.

If desired, any suitable blocking layer may be interposed between the conductive layer and the charge generating layer. A prefered blocking layer comprises a reaction product between a hydrolyzed silane and a metal oxide layer of a conductive anode. The imaging member is prepared by depositing on the metal oxide layer of a metallic conductive anode layer a coating of an aqueous solution of the hydrolyzed silane at a pH between about 4 and about 10, drying the reaction product layer to form a siloxane film and applying an optional adhesive layer, the generating layer, and the charge transport layer to the siloxane film. Typical hydrolyzable silanes include 3-aminopropyl triethoxy silane, (N,N-dimethyl 3-amino) propyl triethoxysilane, N,N-dimethylaminophenyl triethoxy silane, N-phenyl aminopropyl trimethoxy silane, triethoxy silylpropylethylene diamine, trimethoxy silylpropylethylene diamine, trimethoxy silylpropyldiethylene triamine and mixtures thereof.

Generally, dilute solutions are preferred for achieving thin coatings. Satisfactory reaction product films may be achieved with solutions containing from about 0.1 percent by weight to about 1.5 percent by weight of the silane based on the total weight of the solution.

Any suitable technique may be utilized to apply the hydrolyzed silane solution to the metal oxide layer of a metallic conductive layer. Typical application techniques include spraying, dip coating, roll coating, wire wound rod coating, and the like. Generally, satisfactory results may be achieved when the reaction product of the hydrolyzed silane and metal oxide layer forms a layer having a thickness between about 20 Angstroms and about 2,000 Angstroms.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. This siloxane coating is described in U.S. Pat. No. 4,464,450, entitled "Multi-layer Photoreceptor Containing Siloxane on a Metal Oxide Layer", the disclosure of this application being incorporated herein in its entirety.

In some cases, intermediate layers between the blocking layer and the adjacent charge generating or photogenerating material may be desired to improve adhesion or to act as an electrical barrier layer. If such layers are utilized, they preferably have a dry thickness between about 0.01 micrometer to about 5 micrometers. Typical adhesive layers include film-forming polymers such as polyester, du Pont 49,000 resin (available from E. I. du Pont de Nemours & Co.), polyvinylbutyral, polyvinylpyrolidone, polyvinylacetate, polyurethane, polymethylmethacrylate and the like.

Any suitable charge generating or photogenerating material may be employed in one of the two or more electrically operative layers in the multilayer photoconductor prepared by the process of this invention. The photogenerating layer includes, for example, numerous photoconductive charge carrier generating materials provided that they are electronically compatible with the charge carrier transport layer, that is, they can inject photoexcited charge carriers into the transport layer and charge carriers can travel in both directions across the interface between the two layers. The light absorbing photogeneration layer may contain organic photoconductive pigments and/or inorganic photoconductive pigments. Typical organic photoconductive pigments include vanadyl phthalocyanine and other phthalocyanine compounds described in copending application U.S. Ser. No. 487,953, filed on Apr. 25, 1983, entitled "Overcoated Photoresponsive Devices", metal-free phthalocyanine described in U.S. Pat. No. 3,357,989, metal phthalocyanines such as copper phthalocyanine, quinacridones available from DuPont under the tradename Monastral Red, Monastral Violet and Monastral Red Y, substituted 2,4-diamino-triazines disclosed in U.S. Pat. No. 3,442,781, squaraine pigments, such as hydroxyl squarilium pigments, squarylium compounds disclosed in copending application U.S. Ser. No. 613,137, filed on May 23, 1984, entitled "Silylated Compositions and Deuterated Hydroxyl Squaraine Compositions and Processes", pyridinium compounds, azo dyes, diazo dyes, polynuclear aromatic quinones available from Allied Chemical Corporation under the tradename Indofast Double Scarlet, Indofast Violet Lake B, Indofast Brilliant Scarlet and Indofast Orange, thiopyrylium pigments, and the like. Typical inorganic photosensitive pigments include amorphous selenium, trigonal selenium, mixtures of Groups IA and IIA elements, $As_2Se_3$, selenium alloys, cadmium selenide, cadmium sulfo selenide, copper and chlorine doped cadmium sulfide, trigonal selenium doped with sodium carbonate as described in U.S. Pat. Nos. 4,232,102 and 4,233,283, and the like. Other examples of charge generator layers are disclosed in U.S. Pat. No. 4,265,990, U.S. Pat. No. 4,233,384, U.S. Pat. No. 4,306,008, U.S. Pat. No. 4,299,897, U.S. Pat. No. 4,232,102, U.S. Pat. No. 4,233,383, U.S. Pat. No. 4,415,639 and U.S. Pat. No. 4,439,507. The disclosures of these patents are incorporated herein in their entirety.

Any suitable inactive resin binder material may be employed in the charge generator layer. Typical organic resinous binders include polycarbonates, acrylate polymers, vinyl polymers, polyesters, polysiloxanes, polyamides, polyurethanes, epoxides, and the like. Many organic resinous binders are disclosed, for example, in U.S. Pat. No. 3,121,006, U.S. Pat. No. 4,439,507 and U.S. Pat. No. 4,439,507, the entire disclosures of which are incorporated herein by reference. Organic resinous polymers may be block, random or alternating copolymers.

The photogenerating layer containing photoconductive compositions and/or pigments, and the resinous binder material generally ranges in thickness of from about 0.01 micrometer to about 10 micrometers, and preferably has a thickness of from about 0.2 micrometer to about 3 micrometers. Generally, the maximum thickness of this layer is dependent primarily on factors such as mechanical considerations, while the minimum thickness of this layer is dependent on for example, the pigment particle size, optical density of the photogenerating pigment, and the like. Thicknesses outside these ranges can be selected providing the objectives of the present invention are achieved.

The photogenerating composition or pigment is present in the resinous binder composition in various amounts, generally, however, from about 5 percent by weight to about 80 percent by weight, and preferably in an amount of from about 10 percent by weight to about 50 percent by weight. Accordingly, in this embodiment the resinous binder is present in an amount of from about 95 percent by weight to about 20 percent by weight, and preferably in an amount of from about 90 percent by weight to about 50 percent by weight. The specific proportions selected depends to some extent on the thickness of the generator layer.

Several classes of materials commonly known as antioxidants (free radical inhibitors or quenchers or stabilizers for the inhibition of autooxidation and singlet oxygen quenchers for the inhibition of photooxidation) can be used in the photoreceptors. These materials may be incorporated into the photogenerating layer or in both the photogenerating layer and transport layer to improve xerographic performance (e.g. cyclic stability, charge acceptance, and dark decay) and photoreceptor life. It is believed that cycle induced reduction of charge acceptance problems observed in photoreceptors in which the charge transport layer is sandwiched between a conductive substrate and photogenerating layer or in which the photogenerating layer is sandwiched between a conductive substrate and a charge transport layer, photodamage, image deletion and aging problems of photoreceptors can be either reduced or eliminated through the proper use of above materials. These materials may be substituted, unsubstituted, monomeric or polymeric and may perform multiple function. Typical antioxidants (i.e. materials which inhibit autooxidation, photooxidation and sensitized photooxidation) include:

(1) Antioxidants for autooxidation (free radical inhibitors or quenchers or stabilizers) which can prevent or retard the autooxidation of organic material including aromatic diamine charge transport molecules, aromatic amine derivatives and hydrazone compounds. These may also hinder the formation of undesired conductive species in the photoreceptor with or without the presence of light. Many known classes of antioxidants are include: (a) amine derivatives (e.g., aliphatic, cyclic, aromatic and heterocyclic amines), (b) phenolic derivatives (e.g., substituted phenols, butylated hydroxytoluene(2,6-di-t-butyl-p-cresol), butylated hydroxyanisole(2,6-di-t-butyl-4-methoxyphenol and 2-t-butyl-4-methoxyphenol), 2,6-di-t-butylphenol, alpha-tocopherol, other tocopherol related materials, 2,3,6-triphenylphenol, pentaerythrityl tetrakis[beta-(4-hydroxy,3,5-di-t-butylphenyl)proprionate] (Irganox 1010), and the like, (c) sulfides: disulfides, thiodipropionate esters and thiols, (d) aryl phosphites, and (e) organo tin and boron compounds.

(2) Antioxidants for the inhibition of sensitized photooxidation involving singlet oxygen. Antioxidants such as singlet oxygen quenchers involve a wide variety of useful materials. These include various hydroxybenzene derivatives such as 2,6-di-t-butylphenol, butylated hydroxytoluene, butylated hydroxyanisole, alpha-tocopherol, tocopherol derivatives. Irganox 1010, 2,4,6-triphenylphenol, hydroquinones and phenolic polymers. Hindered substituted phenols are particularly effective.

All these materials in principle can protect, in various degrees, photoreceptors from photooxidative damages and thus prolong photoreceptor life for various periods of time.

The stabilizing materials effective for the purposes of this invention exhibit a superior ability to deactivate a range of degradative species such as free radicals, oxidizing agents and singlet oxygen. Generally, the class of materials exhibiting this activity that would be useful in the composite electrophotographic imaging members of this invention are hydroxyaromatic antioxidant compounds. These hydroxyaromatic antioxidant compounds are phenol derivatives having excellent singlet oxygen quenching and free radical inhibiting characteristics.

The hydroxyaromatic antioxidant may comprise a compound having the structural formula

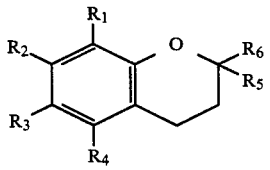

wherein $R_1$, $R_2$, $R_3$, and $R_4$ are independently selected from hydrogen, a hydroxyl group, an alkoxy group containing 1 to 6 carbon atoms, and an alkyl group containing 1 to 6 carbon atoms, wherein at least one of said $R_1$, $R_2$, $R_3$, and $R_4$ is a hydroxyl group, and $R_5$ and $R_6$ are independently selected from hydrogen, an alkenyl group containing 2 to 40 carbon atoms, and an alkyl group containing 1 to 40 carbon atoms. Typical hydroxyaromatic antioxidant encompassed within this formula include alpha-tocopherol[2,5,7,8-tetramethyl-2-(4',8',12'-tri-methyltridecyl)-6-chromanol] and isomers thereof, beta-tocopherol[3,4-dihydro-2,5,8-trimethyl-2-(4,8,12-trimethyltridecyl)-2H-1-benzopyran-6-ol], gammatocopherol[3,4-dihydro-2,7,8-trimethyl-2-(4,8,12-trimethyltridecyl)-2H-1-benzopyran-6-ol]delta-tocopherol[3,4-dihydro-2,8-dimethyl-2-(4,8,-12-trimethyltridecyl)-2H-1-benzopyran-6-ol], epsilon-tocopherol[3,4-dihydro-2,5,8-tetramethyl-2-(4,8,12-trimethyl-3,7,11-tridecatrienyl)-2H-1-benzopyran-6-ol], $zeta_1$-tocopherol[3,4-dihydro-2,5,7,8-tetramethyl-2-(4,8,12-trimethyl-3,7,11-tridecatrienyl)-2H-1-benzopyran-6-ol], $zeta_2$-tocopherol[3,4-dihydro-2,5,7-trimethyl-2-(4,8,12-trimethyltridecyl)-2H-1-benzopyran-6-ol], eta-tocopherol, tocol[3,4-dihydro-2-methyl-2-(4,8,12-trimethyltridecyl)-2H-1-benzopyran-6-ol], and the like and mixtures thereof.

Moreover, the hydroxyaromatic antioxidant may comprise a phenolic compound having the structural formula

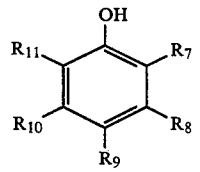

wherein $R_7$, $R_8$, $R_9$, $R_{11}$ and $R_{10}$ are independently selected from hydrogen, a hydroxyl group, a linear alkyl group containing 1 to 20 carbon atoms, a branched alkyl group containing 1 to 20 carbon atoms, an unsubstituted phenyl group, a substituted phenyl group, a napthyl group, an ester group, and an alkoxy group containing 1 to 20 carbon atoms. Typical phenolic compounds encompassed within this formula include 2-tert-butyl-4-methoxyphenol, 2,6-di-t-butyl-4-methoxyphenol, hydroquinones, 2,6-di-tert-butyl-4-ethoxyphenol, 2,6-di-tert-butylphenol, 2,5-di-t-butyl-4-methoxyphenol. 2,6-di-t-butyl-p-cresol. 2,4,6-triphenylphenol, erythrityl tetrakis [beta-(4-hydroxy,3,5-di-t-butylphenyl)propionate], and the like and mixtures thereof. The phenolic compounds 2,6-di-tert-butyl-4-methylphenol, 2,6-di-tert-butyl-4-methoylphenol, 2,6-di-tert-butylphenol, hydroquinones, 2-tert-butyl-4-methoxyphenol, erythrityl tetrakis[beta-(4-hydroxy-3,5-di-tert-butylphenyl)propionate are preferred.

If desired, the hydroxyaromatic compound may be selected from the group consisting of unsubstituted naphthol compounds. Typical substituted and unsubstituted napthol compounds include 1-hydroxy-4-methyl-8-tert-butyl naphthalene, 1-hydroxy-4-ethyl-8-tert-butyl naphthalene, 1-hydroxy-4-propyl-8-tert-butyl naphthalene, 1-hydroxy-4-butyl-8-tert-butyl naphthalene, 1-hydroxy-4-methoxy-8-tert-butyl naphthalene, 1-hydroxy-4-ethoxy-8-tert-butyl naphthalene, 1-hydroxy-4-propoxy-8-tert-butyl naphthalene, 1-hydroxy-4-butoxy-8-tert-butyl naphthalene, 1-hydroxy-2-tert-butyl-4-methyl naphthalene, 1-hydroxy-2-tert-butyl-4-ethyl naphthalene, 1-hydroxy-2-tert-butyl-4-propyl naphthalene, 1-hydroxy-2-tert-butyl-4-butyl naphthalene, 1-hydroxy-2-tert-butyl-4-methoxy naphthalene, 1-hydroxy-2-tert-butyl-4-ethoxy naphthalene, 1-hydroxy-2-tert-butyl-4-propoxy naphthalene, 1-hydroxy-2-tert-butyl-4-butoxy naphthalene, 1-hydroxy-2,8-di-tert-butyl-4-methyl naphthalene, 1-hydroxy-2,8-di-tert-butyl-4-ethyl naphthalene, 1-hydroxy-2,8-di-tert-butyl-4-propyl naphthalene, 1-hydroxy-2,8-di-tert-butyl-4-butyl naphthalene, 1-hydroxy-2,8-di-tert-butyl-4-methoxy naphthalene, 1-hydroxy-2,8-di-tert-butyl-4-ethoxy naphthalene, 1-hydroxy-2,8-di-tert-butyl-4-propoxy naphthalene, 1-hydroxy-2,8-di-tert-butyl-4-butoxy naphthalene, and the like and mixtures thereof.

Alpha tocopherol is the most preferred because of its greater antioxidative efficiency for inhibiting free radical and singlet oxygen reactions and non-toxic properties. The expression "alpha tocopheral" is intended to include the isomers thereof such as the d, l and dl forms. The hydroxyaromatic compounds 2,6-di-t-butyl-p-cresol and 2-t-butyl-4-methoxyphenol are also highly desirable for improving photoreceptor performance and for their nontoxic properties.

The desired antioxidants may be added to known photogeneration layer coating fabrication formulations. The chemicals should be soluble in the coating solvent and be dispersible in the photoconductive pigment polymer matrix. If added to both the photogeneration layer and transport layer, the antioxidant should be soluble in the coating solvent systems employed for both the photogeneration layer and transport layer. It is desirable that the antioxidant be homogeneously dispersed in the photogeneration layer and transport layer after drying. The antioxidant may be applied in a solution together with a photoconductive pigment and a film forming binder to form the photogeneration layer.

Any suitable solution coating techniques may be used to fabricate the layer containing the antioxidant of this invention. Typical solution coating techniques include dip coating, spray coating, roll coating, wire coating, exstrusion coating and the like.

The antioxidants may be employed either in a monomeric or polymeric form. Satisfactory results may be achieved when the photogeneration layer contains from about 0.01 percent by weight to about 20 percent by weight of the antioxidant based on the total weight of the photogeneration layer. When less than about 0.01 percent by weight is employed, print deletion and poor contrast in the final copy are observed when imaged after rest exposure of the photoreceptor under a corotron following image cycling or upon exposure of the photoreceptor to short wavelength light e.g. U.V. Residual voltage build-up and poor photdischarge efficiency can occur when an excessive amount of the antioxidant is used in the photogeneration layer. Preferably, the photogeneration layer contains from about 0.1 percent by weight to about 10 percent by weight of the antioxidant based on the total weight of the photogeneration layer. Optimum results are achieved with about 0.5 percent by weight to about 5 percent by weight of the antioxidant. Since effect of the antioxidant depends to some extent on the particular electrophotographic imaging member treated and the specific antioxidant employed, the optimum concentration of the antioxidant can be determined experimentally.

The antioxidants preferably do not significantly adversely affect the electrical and physical properties of the electrophotographic imaging member. Thus, such antioxidants should not significantly change the desired electrical properties of the photogeneration layer material or of any of the other layers present in the electrophotographic imaging member. Additionally, when selecting the stabilizing additive of this invention, it is important that these materials do not introduce undesired conducting states or species in the layer as a result of any chemical reactions. Additionally, the antioxidant additives of the present invention should be selected so that they do not interfere with the useful functions of other components in the electrophotographic imaging member. Moreover, the antioxidants preferably not introduce harmful charge carrier traps into the photoreceptor layers because such introduction will cause deterioration of the photoresponsive properties.

Any suitable solution coating techniques may be used to fabricate photogeneration layer and transport layer which contain the antioxidants of this invention. Typical solution coating techniques include dip coating, spray coating, roll coating, wire coating, exstrusion coating and the like. The spray coating technique is preferred for the coating of photogeneration layer for photoreceptors in which the charge transport layer is sandwiched between the conductive layer and the photogeneration layer and for the coating of charge transport layer of photoreceptors in which the photogeneration layer is sandwiched between the conductive layer and the charge transport layer because it can minimize the diffusion of oxidizable charge transport molecules into the photogeneration layer.

The antioxidants of this invention may be employed alone or in conjunction with additives such as hydroxypropylcellulose or the like, a weak hole trapping material, in the photogeneration layer to improve the charge acceptance capability of a photoreceptor and to reduce the cycle induced reduction of charge acceptance problem of photoreceptors. Photoreceptors containing a photoconductive pigment such as vanadyl phthalocyanine pigment or other types of photoconductive pigments or dyes in a photogeneration layer of a photoreceptor, in which a charge transport layer is sandwiched between the photogeneration layer and a conductive layer, can exhibit unstable charge acceptance in the first few imaging cycles either before or after dark resting. The use of the hydroxypropylcellulose additive of this invention minimizes this problem thereby improving the long-term stability of photoreceptors and increasing the life of the photoreceptor. Both the initial and long-term cycle induced reduction of charge acceptance problems can be minimized with use of the antioxidants of this invention and a weak hole trapping material such as hydroxypropylcellulose or the like in the photogeneration layer.

The antioxidants of this invention are employed in an electrophotographic imaging member which utilizes organic hole transport layers. Typical organic hole transport layers utilize various aromatic amine compounds including those described in U.S. Pat. No. 4,265,990, U.S. Pat. No. 3,240,597 and U.S. Pat. No. 3,615,418, the entire disclosures being incorporated herein by reference in their entirety and the like and hydrazone derivatives such as p-diethylaminobenzaldehyde-p-diphenylhydrazone, p-dimethylaminobenzaldehyde diphenylhydrazone, 9-methylcarbazole-3-carbaldehyde-1-methyl-1-phenylhydrazone. 9-methylcarbazole-3-carbaldehyde-1-ethyl-1-phenylhydrazone, 9-ethylcarbazole-3-and carbaldehyde-1-ethyl-1-phenylhydrazone including those described in U.S. Pat. No. 4,150,987, U.S. Pat. No. 4,256,821, U.S. Pat. No. 4,365,014 the entire disclosures being incorporated herein by reference in their entirety and the like.

The preferred charge transport layer employed in one of the two electrically operative layers of the multilayered or composite photoconductor prepared by the process of this invention comprises about 25 to about 75 percent by weight of at least one charge transporting aromatic amine compound or hydrazone derivative, about 75 to about 25 percent by weight of an polymeric film forming resin in which the charge transporting compound is homogeneously dispersed, and optionally about 1 to about 10,000 parts per million based on the weight of the charge transporting compound of protonic acid or Lewis acid soluble in a suitable solvent such as methylene chloride. The charge transport layer generally has a thickness in the range of from about 5 to about 50 micrometers, and preferably a thickness of from about 10 to about 40 micrometers.

The aromatic amine compound may be of one or more compounds having the general formula:

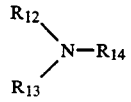

wherein $R_{12}$ and $R_{13}$ are an aromatic group selected from the group consisting of a substituted or unsubstituted phenyl group, naphthyl group, and polyphenyl group and $R_{14}$ is selected from the group consisting of a substituted or unsubstituted aryl group, alkyl group having from 1 to 18 carbon atoms and cycloaliphatic compounds having from 3 to 18 carbon atoms or a hydrazone molecule having the general formula:

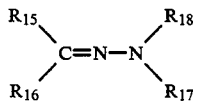

wherein $R_{15}$, $R_{16}$, $R_{17}$ and $R_{18}$ are selected from the group consisting of hydrogen, substituted or unsubstituted phenyl group, naphthyl group, carbazoyl group, biphenyl group, diphenyl ether group, alkyl group having 1 to 18 carbon atoms, and cycloaliphatic group having 1 to 18 carbon atoms.

A preferred aromatic amine compound has the general formula:

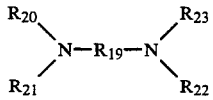

wherein $R_{19}$ is selected from the group consisting of a substituted or unsubstituted phenyl group, biphenyl group, diphenyl ether group, alkyl group having from 1 to 18 carbon atoms, and cycloaliphatic group having from 3 to 12 carbon atoms and $R_{20}$, $R_{21}$, $R_{23}$ and $R_{22}$ are an aromatic group selected from the group consisting of substituted or unsubstituted phenyl group, napthyl group and polyphenyl group. The substituents should be free from electron withdrawing groups such as $NO_2$ groups, CN groups, and the like: Generally these aromatic amines have an ionization potential of below about 7.7 e.v.

Examples of charge transporting aromatic amines represented by the structural formula above for charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis(diethylamino)-2',2''-dimethyltriphenyl-methane, N,N'-bis(alkylphenyl)-[1,1'-biphenyl]-4,4'-diamine wherein the alkyl is, for example: methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. This inert highly insulating resinous binder, which has a resistivity of at least about $10^{12}$ ohm-cm to prevent undue dark decay, is a material which is not necessarily capable of supporting the injection of holes from the photogenerator layer, and is not capable of allowing the transport of these holes through the material. Typical inactive resin binders soluble in methylene chloride or other suitable organic solvent include polycarbonate resins commercially available as Makrolon, Merlon and Lexan, polyesters, polystyrenes, polyarylates, polyacrylates, polyethers, polysulfones, and the like. Molecular weights can vary from about 8,000 to about 1,500,000.

If desired, the antioxidant of this invention can simultaneously be employed in both the charge generation layer and the charg transport layer.

It is believed that the cyclic instability is caused by corotron by-products, photochemical reactions, electrochemical reactions and autooxidation processes rendering the photoreceptor undesirably conductive. The conductive region causes poor charge acceptance on the surface of the photoreceptor resulting in print deletions or poor image quality in higher speed electrophotographic machines. This electrically conductive region contains undesirable charged species that are probably by-products of the polymers and/or the charge transport molecule, e.g. a positive diamine compound, and polymer with negative counter charges. When the device is charged with positive charges on the imaging surface, free positive charges from the imaging surface region are injected into the transport layer of the photographic imaging member prior to photodischarge thereby lowering the charge acceptance of the affected region. If on the other hand the electrophotographic imaging member exhibiting cyclic instability and poor charge acceptance is charged with negative charges on the imaging surface, positive free charges resulting from the autooxidation, photooxidation and electrochemical reaction can migrate from the nearby conductive substrate region through the hole transport layer to the top surface prior to photodischarge and cause poor charge acceptance, cyclic instability and poor image quality.

Any suitable and conventional technique may be utilized to mix and thereafter apply the charge transport layer coating mixture to the imaging member. Typical application techniques include spray coating, dip coating, roll coating, wire wound rod coating, and the like. Drying of the deposited coating may be effected by any suitable conventional technique such as oven drying, infra red radiation drying, air drying and the like. Generally, the thickness of the charge transport layer is between about 5 to about 100 microns, but thicknesses outside this range can also be used.

The charge transport layer should be an insulator to the extent that the electrostatic charge placed on the imaging surface of the photoreceptor are not conducted or discharged in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1. A typical transport layer forming composition contains about 20–50 percent by weight charge transporting aromatic amine or hydrazone, about 80–50 percent by weight polymeric binder and about 50–95 percent by weight of a coating solvent such as methylene chloride.

In some cases, intermediate layers such as an adhesive layer and/or blocking layer between the conductive layer and the adjacent charge generating layer or transport layer may be desired to improve adhesion or to act as an electrical barrier layer. If such layers are utilized, the layers preferably have a dry thickness between about 20 Angstroms to about 5 microns. Typical adhesive layers include film-forming polymers such as polyesters, du Pont 49,000 resin, polyvinylbutyral, polyvinylpyrolidone, polyvinylacatate, polyurethane, polyalkylacrylates, polyalkylmethacrylates and the like. Conductive substrates treated with gamma aminopropyl triethoxy silane type hole blocking materials as disclosed, for example, in U.S. Pat. Nos. 4,464,450 and 4,291,110, and hydroxyethylcellulose, hydroxypropylcellulose, hydroxybutylcellulose, hydroxypentylcellulose, hydroxyhexylcellulose, or the like described in copending U.S. application Ser. No. 686046, entitled "Electrophotographic Imaging System", filed in the names of J. W-P. Lin and L. P. Dudek on the same date as the instant application, can be used in the fabrication of a blocking layer for photoreceptors, in which the imaging surface is charged with negative charges, to prevent undesirable premature hole injections through the photoreceptor. The disclosures of these patents and application are incorporated herein in their entirety. For photoreceptors in which the imaging surface is charged with positive charges, the hole blocking layer is preferably located near or at the outer surface of the photogenerating layer. Any suitable hole blocking material selected from those described above may be used for the photoreceptors of this invention.

Optionally, an overcoating layer may also be utilized to improve resistance to abrasion. These overcoating layers may comprise organic polymers or inorganic polymers that are electrically insulating or slightly semi-conductive. The overcoating layer generally ranges in thickness of from about 0.05 micrometer to about 10 micrometers, and preferably has a thickness of from about 0.2 micrometer to about 5 micrometers and comprises materials that are capable of absorbing ultraviolet light so as to minimize ultraviolet light degradation of the electron donor arylamine materials or hydrazone derivatives contained in the transport layer and/or in the photogenerating layer. Also, this overcoating layer can function as a protective layer for the photoresponsive device. Illustrative examples of materials selected for the overcoating layer include selenium, alloys of selenium, such as arsenic selenium, containing 0.1 to 50 percent by weight of arsenic and 99.9 to about 50 percent by weight selenium, arsenic selenium alloys containing halogens, such as chlorine or iodine, in an amount of from about 1 part per million to about 1 percent, as well as selenium tellurium alloys, arsenic selenium tellurium alloys, the above selenium alloys containing germanium, and the like.

Other overcoating materials not specifically disclosed herein may also be selected providing the objectives of the present invention are achieved including, for example, other inorganic and organic materials, such as silicone polymers. Additionally, suitable solvent soluble organic polymers may be used. Illustrative examples of typical organic materials include various polymers containing therein organic and/or inorganic ultraviolet light absorbers. Examples of these materials include polycarbonates, polyesters, silicon polymers, siloxanes and the like, having dispersed therein ultraviolet light absorbers, such as zinc oxide, amorphous or crystalline particles of selenium, arsenic, or selenium tellurium alloys and the like. Generally, any ultraviolet light absorbers may be present in the organic material in an amount ranging from about 5 percent by weight to about 40 percent by weight, and preferably in an amount of from about 10 percent by weight to about 20 percent by weight.

If desired, the antioxidant of this invention can simultaneously be employed in both the charge generation layer and a suitable overcoating layer.

The photogenerating layers prepared in accordance with the process of the present invention are useful in various photoconductive devices. In one embodiment, there can be prepared a layered photoresponsive device comprising in the following sequence an electrically conductive substrate, an optional blocking layer, an optional adhesive layer, a photogenerating layer prepared in accordance with the present invention, a charge transport layer, and an optional overcoating layer. In another embodiment, the photoresponsive device comprises in the following sequence an electrically conductive substrate, an optional electron blocking layer, an optional adhesive layer, a charge transport layer, a charge generating layer prepared in accordance with the present invention, and an optional overcoating layer. In still another embodiment, photoresponsive devices useful in imaging systems may comprise in the following sequence an electrically conductive substrate, an optional blocking layer, an optional adhesive layer, a charge generating layer, a charge generating layer prepared in accordance with the present invention, a charge transport layer and an optional overcoating layer.

A specific example illustrating a preferred layered photoresponsive device of the present invention comprises a conductive substrate such as an aluminum drum having a thickness of 4 millimeters, a hole transport layer containing 35 percent by weight of diamine dispersed in 65 percent by weight of a polycarbonate commercially available as Merlon, this layer having a thickness of from about 10 micrometers to about 25 micrometers, a photogenerating layer, comprising 30 percent by weight of vanadyl phthalocyanine and 0.8–6 percent by weight alpha-tocopherol dispersed in 69.2–64 percent by weight of a polyester material, PE-100, commercially available from Goodyear Corporation, this layer having a thickness of 1 micrometer, and a protective layer comprising an arsenic selenium alloy, containing 2 weight percent of arsenic and 98 weight percent of selenium, this layer having a thickness of 1.0 micrometer. This preferred layered photoresponsive device was prepared by applying by spraying an aromatic amine charge transport layer onto a clean aluminum cylinder having a diameter of 83 millimeters. The aluminum cylinder was rotated about the vertical axis of a mandrel at 290 revolutions per minute. The spraying was conducted at a temperature of 20 degrees centigrade and a relative humidity of about 40 percent. The charge transport layer applied contained a 4 percent solid solution of a mixture of 65 percent by weight of the polycarbonate resin (Merlon M 39N, available commercially from Mobay Chemical) and 35 percent by weight of N,N'-diphenyl-N,N'-bis(3-methylphenyl)-1,1'-biphenyl-4,4'-diamine. This mixture was prepared by dissolving in a 0.5 liter amber bottle the polycarbonate resin in a solution containing 60 percent by volume of methylene chloride and 40 percent by volume 1,1,2-trichloroethane. The polycarbonate resin was dissolved by tumbling the solution mixture for one hour on a paint shaker, and after tumbling the resulting mixture was allowed to stand for about 24 hours at room temperature. There was then added to the resulting solution N,N'-diphenyl-N,N'-bis(3-methylphenyl)-1,1'-biphenyl-4,4'-diamine, which diamine was dissolved therein by tumbling the mixture for two hours on a paint shaker. After tumbling, the resulting mixture was allowed to remain at room temperature for about 24 hours. The resulting solution was then applied to the aluminum cylinder, by spraying followed by drying at 40° C. for 20 minutes, and 160° C. for 60 minutes, the drying being effected in a forced air oven. The resulting charge transport layer was thereafter coated with a photogenerating layer by spraying a photogenerating layer containing 30 percent by weight of vanadyl phthalocyanine and 0.8–6 percent by weight alpha-tocopherol dispersed in 69.2–64 percent by weight of a polyester. The photogenerating composition was prepared by mixing 30 percent by of weight vanadyl phthalocyanine 0.8–6 by weight alphatocopherol and 69.2–64 percent by weight of a polyester (PE-100 polyester, commercially available from Goodyear Tire and Rubber Co.). This mixture was placed in a 1 liter amber bottle containing in a 60/40 volume ratio, a mixture of solvents of methylene chloride and 1,1,2-trichloroethylene. To the bottle was added steel shot 3 millimeters in diameter. The contents of the bottle were then mixed on a paint shaker for 24 hours. After removing the steel shot by filtration, there was added to the resulting slurry sufficient additional solvents so as to result in a mixture containing 1 percent solids of vanadyl phthalocyanine and the PE-100 polyester. This mixture was then sprayed onto the above prepared diamine charge transport layer. After spraying, the resulting device was dried at 100° C. for 1.25 hours hours in a forced air oven resulting in a photogenerating layer having a dry thickness of 1 micrometer. An overcoating layer was then applied to the photogenerating layer by placing the aluminum cylinder containing the charge transport layer and photogenerating layer in a vacuum chamber and vacuum evaporating on the photogenerating layer an alloy containing 98 percent by weight of selenium and 2 percent by weight of arsenic. The resulting photogenerating layer had an overcoating layer of an arsenic selenium alloy containing 2 percent by weight of arsenic and 98 percent by weight of selenium having a thickness of 1 micrometer. This preferred photoresponsive device comprised in sequence (1) an aluminum substrate, (2) a diamine charge transport layer, (3) a photogenerating layer of vanadyl phthalocyanine and alpha-tocopherol, and (4) and overcoating layer containing a selenium arsenic alloy.

The above prepared device was then charged positively to 934 volts with a corotron and was found to be electrically stable over 18,000 imaging cycles, in that the device retained a positive charge of 884 volts as measured with an electrostatic voltmeter, commercially available from Monroe Electronics Inc. of Rochester New York. Moreover, the photoresponsive device sensitivity ranged from 90 volts/erg/cm$^2$ at 400 nanometers to 60 volts/erg/cm$^2$ at 900 nanometers, as measured with an electrostatic voltmeter, commercially available from Monroe Electronics Inc. of Rochester New York. This indicates that images can be formed on this device over a wavelength ranging from 400 nanometers to 900 nanometers.

Electrophotographic imaging members containing the antioxidants of this invention may be exposed to any imaging light source including U.V., visible and near infrared light. The preferred photoresponsive device of the present invention is particularly useful primarily in an infrared imaging device wherein light emitted by solid state lasers are utilized. Such a device has sensitivity ranging from about 700 nanometers to about 900 nanomaters, and thus can be selected for use with solid state lasers, including gallium aluminum arsenide lasers and gallium arsenide lasers. Thus, employment of these photoreceptors with near infrared light generated from laser diodes is preferred because of the longer wavelengths employed and the lower energy utilized. However, as disclosed herein, the photoresponsive devices of the present invention are also sensitive to visible light, that is light having a wavelength of from about 350 nanometers to about 700 nanometers.

Photoreceptors containing the antioxidants of this invention exhibit better charge acceptance capability than untreated photoreceptors upon exposure to U.V. radiation and short wavelength light. It is believed that these antioxidants prevent the undesirable photooxidation and autooxidation of hole transporting materials including aromatic amines and hydrazones in the transport layer which leads to the formation of conductive bands, poor charge acceptance and cyclic instability. The dark decay rate of a photoreceptor comprising a charge transport layer sandwiched between a conductive layer and a photogeneration layer can be reduced because of the protective action of the antioxidants of this invention. It is believed that the oxidation of aromatic amine charge transport molecules to produce conductive species is a major cause for the increase of dark decay, the decline in the charging capability of a photoreceptor and poor cyclic performance. Apparently, the autooxidation and photooxidation processes of a low ionization potential hole transport material such as various aromatic amine and hydrazone derivatives can be retarded significantly by the additives of this invention.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and processes and can have many different uses in accordance with the disclosure above and as pointed out hereinafter.

EXAMPLE I

A sheet of aluminized polyester substrate (Mylar, available from E. I. du Pont de Nemours & Co.) having a thickness of 3 mils and bearing a 0.05 micrometer thick adhesive layer of a polyester resin (DuPont 49,000, available from E. I. du Pont de Nemours & Co.) was overcoated with a 20 micrometers thick charge transport layer containing 40 percent by weight of N,N'-diphenyl-N,N'-bis(3-methylphenyl)-1,1'-biphenyl-4,4'-diamine dispersed in 60 percent by weight of polycarbonate resinous binder (Makrolon ®, a polycarbonate resin having a molecular weight of from about 50,000 to 100,000, available from Larbensabricken Bayer A. G.). A dispersion of photoconductive pigment was prepared by adding 0.128 gram of vanadyl phthalocyanine and 50 grams of 0.125 inch no. 302 stainless steel shot to a solution of 0.379 gram of polyester resin (Vitel PE-100, available from Goodyear Tire and Rubber Co.) in 8.0 ml of dichloromethane in a 2 oz. amber bottle followed by shaking on a paint-shaker. The dispersion was coated onto the charge transport layer with a 1.0 mil gap Bird-type applicator bar. The device was air-dried followed by drying under vacuum at 100° C. for 2.5 hours.

EXAMPLE II

A photoreceptor device was prepared by repeating the procedure of Example I with the exception that 3.0 ml instead of 8.0 ml of dichloromethane was used and that 5.0 ml of a 6.4 mg/ml solution of d,l-alpha-tocopheral in dichloromethane was added to the dispersion of photoconductive pigment before shaking.

EXAMPLE III

A photoreceptor device was prepared by repeating the process of Example I with the exception that 6.5 ml instead of 8.0 ml of dichloromethane was used and that 1.5 ml of a 3.80 mg/ml solution of hydroxypropyl cellulose (available from Scientific Polymer Products) in dichloromethane was added to the dispersion of photoconductive pigment before shaking.

EXAMPLE IV

A photoreceptor device was prepared by repeating the process of Example III with the exception that 4.0 ml instead of 6.5 ml of dichloromethane was used and that 2.5 ml of a 3.80 mg/ml solution of pentaerythrityl tetrakis [beta-(4-hydroxy-3,5-di-tert-butylphenyl)proprionate] (Irganox 1010 available from Ciba-Geigy Corporation) in dichloromethane was added to the dispersion of photoconductive pigment before shaking.

EXAMPLE V

A photoreceptor device was prepared by repeating the process of Example IV with the exception that 1.5 ml of dichloromethane and 5.0 ml of the Irganox 1010 solution (3.8 mg/ml) were used.

EXAMPLE VI

A photoreceptor device was prepared by repeating the process of Example III with the exception that 4.0 ml of dichloromethane was used and that 2.5 ml of a 6.32 mg/ml solution of d,l-alpha-tocopherol in dichloromethane was added to the dispersion of photoconductive pigment before shaking.

EXAMPLE VII

A photoreceptor device was prepared by repeating the process of Example VI with the exception that 1.5 ml of dichloromethane and 5.0 ml of the 6.32 mg/ml d,l-alpha-tocopherol solution were used.

EXAMPLE VIII

A photoreceptor device was prepared by repeating the process of Example I with the exception that 7.0 ml instead of 8.0 ml of dichloromethane was used and that 1.00 ml of a 9.51 mg/ml solution of hydroxypropyl cellulose in dichloromethane and 8.80 mg of 2,6-di-tert-butylphenol (available from Aldrich Chemical Co.) were added to the dispersion of photoconductive pigment before shaking.

EXAMPLE IX

Testing was conducted to determine the electrical stability of the photoreceptor devices prepared with and without the antioxidants when exposed to a short wavelength light including ultra violet light. The devices were first tested prior to exposure using a flat plate scanner employing a constant voltage 5.45 KV corotron. The samples were then exposed to the light from a Sylvania F8T5/cwx fluorescent tube in a Thermolyne Model LL-6515 fixture without a diffuser at a distance of 30 cm. After exposure, the devices were dark-rested for 30 minutes and then retested. Successive exposures and testing were carried out on the same devices. A portion of the photoreceptor device prepared by the method of Example 3 was not exposed to the fluorescent light but was tested along with the exposed devices as a control. The results are shown in Table I.

TABLE I

| Device Preparation Method | Electrical Results of Light Exposed Photoreceptors — Exposure Time (sec) 0 | 30 | 60 | 120 | 80 | 300 | 540 | 600 | 1620 |
|---|---|---|---|---|---|---|---|---|---|
| | | | | Surface Potential (V) | | | | | |
| III* | 862 | | 862 | | 860 | | 850 | | 828 |
| III | 822 | | 745 | | 648 | | 462 | | 150 |
| IV | 982 | | 940 | | 852 | | 625 | | 238 |
| V | 935 | | 917 | | 897 | | 808 | | 605 |
| VI | 973 | | 858 | | 915 | | 808 | | 488 |
| VII | 885 | | 887 | | 873 | | 805 | | 647 |
| VII (5.6 KV) | 983 | 918 | | 835 | 783 | 667 | | 427 | |
| | | | | Dark Discharge Rate (v/sec) | | | | | |
| III* | 58 | | 65 | | 70 | | 75 | | 78 |
| III | 73 | | 92 | | 127 | | 150 | | — |
| IV | 33 | | 43 | | 50 | | 73 | | — |
| V | 28 | | 28 | | 32 | | 37 | | 50 |
| VI | 32 | | 35 | | 45 | | 53 | | — |
| VII | 33 | | 32 | | 40 | | 47 | | 57 |
| VIII (5.6 KV) | | 93 | | 135 | 147 | 153 | | 197 | |
| | | | | Residual Voltage (v) | | | | | |
| III* | 15 | | 15 | | 13 | | 13 | | 10 |
| III | 15 | | 15 | | 10 | | 10 | | — |
| IV | 15 | | 15 | | 12 | | 10 | | — |
| V | 15 | | 10 | | 10 | | 10 | | 7 |
| VI | 15 | | 15 | | 12 | | 10 | | — |
| VII | 15 | | 10 | | 10 | | 10 | | 5 |
| VIII (5.6 KV) | | 10 | | 10 | 5 | 5 | | 5 | |

*photoreceptor device (a control) not exposed to the fluorescent or UV light but was tested along with others These results clearly demonstrate that the charge acceptance and dark discharge rate characteristics of the exposed control Example III containing no antioxidant of this invention rapidly degraded within minutes.

EXAMPLE X

A photoreceptor device was prepared by repeating the process of Example I with the exception that 7.0 ml of dichloromethane was used and that there was added to the mixture before shaking, 1.0 ml of a solution consisting of 3.81 mg/ml hydroxypropyl cellulose (HPC) (Klucel EF grade, available from Hercules Inc. ) in dichloromethane.

EXAMPLE XI

A photoreceptor device was prepared by repeating the process of Example X with the exception that 6.0 ml of dichloromethane was used and that there was added to the mixture before shaking 1.0 ml of a solution consisting of 7.64 mg/ml of Sigma Chemical Company d,l-alpha-tocopherol in dichloromethane.

EXAMPLE XII

A photoreceptor device was prepared by repeating the process of Example XI with the exception that 5.0 ml of dichloromethane and 2.0 ml of the 7.64 mg/ml d,l-alpha-tocopherol solution were used.

EXAMPLE XIII

Electrical testing of devices described in Examples X–XII was conducted by charging each with a constant voltage corotron and photodischarging the devices with a specific wavelength (for example 597 nm or 800 nm light.) The charging and photodischarging processes were monitored by an electrometer and recorded on a strip chart recorder. The surface potential of each photoresponsive device just prior to the light exposure is represented by Vddp. The maximum sensitivity was calculated as the maximum photodischarge rate divided by the radiant power of the light, and the energy to ½ $V_{ddp}$ was the light energy required to discharge the device to ½ of its original surface potential value. The results are shown in Table II.

TABLE II

Electrical Results of Draw Bar Coated Photoreceptors

| Device No | Corotron Voltage (KV) | Charge Level (V) | Dark Decay (V/sec) | Residual Voltage (V) | Maximum Sensitivity 597 nm (V cm²/erg) | Energy to ½ Vddp 597 nm (erg/cm²) | Maximum Sensitivity 800 nm (V cm²/erg) | Energy to ½ Vddp 800 nm (erg/cm²) |
|---|---|---|---|---|---|---|---|---|
| X | 5.45 | 848 | 58 | 13 | 138 | 5.93 | 114 | 8.21 |
| XI | 5.45 | 895 | 32 | 13 | 146 | 5.41 | 105 | 8.11 |
| XII | 5.45 | 950 | 30 | 15 | 158 | 5.22 | 119 | 7.47 |

The combined use of hydroxypropyl cellulose and alpha-tocopherol in the photoreceptor device causes an increase in charging capability and a reduction in dark decay rate. The residual voltage is not affected by the use of the combination of antioxidant and additive.

EXAMPLE XIV

A photoreceptor device was prepared by repeating the process of Example I with the exception that the dispersion also contained 1.92 mg of hydroxypropyl cellulose (available from Scientific Polymer Products).

EXAMPLE XV

A photoreceptor device was prepared by repeating the process of Example I with the exceptions that the dispersion also contained 5.7 mg of hydroxypropyl cellulose and 32 mg of d,l-alpha-tocopherol.

EXAMPLE XVI

A photoreceptor device was prepared by repeating the process of Example I with the exception that the final device was overcoated with a vacuum deposited 1.0 micrometer thick layer of a selenium alloy containing 2% by weight As and 98 by weight Se.

EXAMPLE XVII

A photoreceptor device was prepared by repeating the process of Example I with the exceptions that the dispersion also contained 32 mg of d,l-alpha-tocopherol and that the final device was thereafter overcoated with a vacuum deposited 1.0 micrometer thick layer of a selenium alloy containing 2% by weight As and 98 by weight Se.

EXAMPLE XVIII

A photoreceptor device was prepared by repeating the process of Example I with the exception that the dispersion also contained 5.7 mg of hydroxypropyl cellulose and that the final device was thereafter overcoated with a vacuum deposited 1.0 micrometer thick layer of a selenium alloy containing 2% by weight As and 98 by weight Se.

EXAMPLE XIX

A photoreceptor device was prepared by repeating the process of Example I with the exception that the dispersion also contained 5.7 mg of hydroxypropyl cellulose and 32 mg of d,l-alpha-tocopherol and that the final device was then overcoated with a vacuum deposited 1.0 micrometer thick layer of a selenium alloy containing 2% by weight As and 98 by weight Se.

EXAMPLE XX

Photoreceptor devices described above were mounted on a cylindrical metal drum were placed in a test fixture for cyclic testing. The test fixture consisted of a light-tight, temperature and humidity controlled chamber. The drum was mounted on a motor-driven, rotatable shaft. Rotation of the drum caused the devices to pass sequentially under a constant current charge corotron, a wavelength controlled exposure lamp and a white-light erase lamp. Surface potential measurement probes were positioned along the periphery of the drum to determine surface charge on the sample device before and after the corotron, exposure lamp, and erase lamp. The data collected included: $V_1$, the charge acceptance on the first test cycle; $V_{100}$, the charge acceptance on the 100th test cycle; the dark discharge rate, the relative rate of decrease in surface potential after charging without consecutive imaging light exposure; $V_R$, the residual voltage calculated as the potential remaining after an infinate exposure for a given wavelength of light, in this case 825 nm; $V_c$, the potential where the slope of a line tangent to a discharge curve equals S/2; a relative measure of discharge curve shape and, sensitivity as measured by the decrease in surface potential with light exposure. In normal testing, the sample devices were cycled 18,000 times, dark-rested for 24 hours and retested the difference in charge acceptance potential observed between the 18001 cycle and the 18100 cycle after dark resting and retesting is referred to as CIRCA (Cycle-up In Rested Charge Acceptance). The decrease in charge acceptance potential which is often observed in $V_{100}$ after dark-resting and retesting (18,100 cycles) and that observed in the first cycle (18,001 cycles) is termed CIRCA. $V_{18,100}-V_{18,001}$ is referred to as cycle up if positive and cycle down if negative. The electrical results are shown in Table III.

TABLE III

| Device No | $V_{100}$ Initial/Stressed | $V_{100}$-V1 | ΔV Initial/Stressed | CIRCA | $S_{825}$ | % HPC | % a-Toc | O/C |
|---|---|---|---|---|---|---|---|---|
| | Electrical Results of Draw Bar Coated Photoreceptors | | | | | | | |
| XIV | 1022/621 | 107 | 188/362 | 364 | 100 | 1.5 | 0 | N |
| XV | 1030/909 | 10 | 88/138 | 59 | — | 1.5 | 6.3 | N |
| XVI | 928/745 | 139 | 202/271 | 216 | 100 | 0 | 0 | Y |
| XVII | 1096/1048 | 59 | 77/97 | 164 | — | 0 | 6.3 | Y |
| XVIII | 1037/611 | 58 | 166/269 | 250 | 90 | 1.5 | 0 | Y |
| XIX | 1160/1125 | 14 | 82/107 | 17 | — | 1.5 | 6.3 | Y |

$V_{100}$ = surface potential after 100 cycles in volts
ΔV = dark decay rate in volts/sec
$S_{825}$ = sensitivity of the device in V-cm$^2$/erg using an 825 nm light source
Initial = without previous testing
stressed = after 18,000 cycles and 24 hours dark-resting
N = no
Y = yes
O/C = 2% As/98% Se alloy (1 micrometer) overcoating The antioxidant, alpha-tocopherol, and additive, hydroxypropyl celulose, improved the initial and long term cyclic stability (stressed condition) of the device either with or without the selenium alloy coating. In addition, the charge acceptance level, dark decay rate and CIRCA characteristics were significantly improved.

The following Examples XXI–XXVI describe the fabrication of photoreceptor devices by a spray-coating method for cyclic stability studies.

EXAMPLE XXI

An aluminum alloy drum was spray coated with a solution consisting of N,N'-diphenyl-N,N'-bis(3-methylphenyl)-1,1'-biphenyl-4,4'-diamine, 40 weight percent, and the polycarbonate resin Makrolon dissolved in a mixture of methylene chloride (60 parts) and trichloroethane (40 parts) and dried to give a 15 micrometers coat. A dispersion of photoconductive pigment was prepared by adding 19.3 g of vanadyl phthalocyanine to a solution of 100 g of Goodyear Vitel PE-100 polyester resin dissolved in 390 ml of 1,2-dichloroethane and 550 ml of dichloromethane and roll milling. 100 ml of this dispersion was diluted with 300 ml of a 1:1.4 volume ratio solution of dichloromethane and 1,2-dichloroethane (referred to as diluent solution hereinafter). This diluted mixture was roll-milled and then spray-coated onto the charge-transport layer coated drum and dried to give a 15 micrometers thick coating. The completed drum was then overcoated with a 3.0 micrometers thick coat of As/Se alloy by a vacuum deposition method at 70° C.

EXAMPLE XXII

A photoreceptor device was prepared by repeating the process of Example XXI with the exception that the diluent solution contained 0.090 gram of d,l-alpha-tocopherol.

EXAMPLE XXIII

A photoreceptor device was prepared by repeating the process of Example XXI with the exception that the diluent solution contained 0.135 grams of d,l-alpha-tocopherol.

EXAMPLE XXIV

A photoreceptor device was prepared by repeating the process of example XXI with the exception that the duluent solution contained 0.090 grams of d,l-alpha-tocopherol and 0.045 g of hydroxypropyl cellulose (Scientific Polymer Products).

EXAMPLE XXV

A photoreceptor device was prepared by repeating the process of Example XXI with the exception that the diluent solution contained 0.270 grams of d,l-alpha-tocopherol and 0.045 grams of hydroxypropyl cellulose.

EXAMPLE XXVI

A photoreceptor device was prepared by repeating the process of Example XXI with the exception that the diluent solution contained 0.090 grams of d,l-alpha-tocopherol and 0.090 grams of hydroxypropyl cellulose.

EXAMPLE XXVII

These spray-coated photoreceptor devices were tested as previously described for cyclic testing in Example XX. The results are shown in Table IV.

TABLE IV

| Sample No | Drum No | t | $V_o$ | $E_o$ | $\Delta V_o$ | $S_{825}$ | $V_{R825}$ | CIRCA | % HPC | % a-T |
|---|---|---|---|---|---|---|---|---|---|---|
| | Electrical Results of Spray Coated Photoreceptors | | | | | | | | | |
| XXI | 1320 | 24.1 | 1054 | 43.7 | 59 | 77 | 59 | 120 | 0 | 0 |
| XXIV | 1323 | 21.9 | 934 | 42.6 | 43 | 63 | 57 | 50 | 0 | 2 |
| XXV | 1324 | 19.1 | 927 | 48.5 | 39 | 61 | 55 | 39 | 0 | 3 |

TABLE IV-continued

| Sample No | Drum No | Electrical Results of Spray Coated Photoreceptors | | | | | | | | |
|---|---|---|---|---|---|---|---|---|---|---|
| | | t | $V_o$ | $E_o$ | $\Delta V_o$ | $S_{825}$ | $V_{R825}$ | CIRCA | % HPC | % a-T |
| XXVI | 1326 | 21.4 | 958 | 44.8 | 35 | 56 | 54 | 23 | 1 | 4 |
| XXVIII | 1328 | 20.8 | 944 | 45.4 | 37 | 58 | 55 | 27 | 1 | 2 |
| XXIX | 1279 | 20.2 | 888 | 43.9 | 36 | 48 | 51 | 10 | 2 | 2 |

t = thickness in micrometers for the photoreceptor excluding the conductive substrate
$V_o$ = initial surface potential in voltage
$E_o$ = field strength v/micrometers
$\Delta V_o$ = dark decay rate v/sec
$S_{825}$ = sensitivity of the P/R in v-cm$^2$/erg using an 825 nm light source
$V_{R825}$ = residual voltage in volts after the exposure
CIRCA = $V_{18,100} - V_{18,001}$ - surface potential difference in volts
HPC = hydroxypropyl cellulose
a-T = alpha-tocopherol The inclusion of the antioxidant, alpha tocopheral, significantly improved the cyclic stability of the photoreceptors by the reduction of CIRCA and delta $V_o$ while other parameters, such as charge acceptance and sensitivity, remained well within desired limits.

EXAMPLE XXVIII

A dispersion of photoconductive pigment was prepared by adding 0.128 gram of vanadyl phthalocyanine and 50 grams of 0.125 inch no. 302 stainless steel shot to a solution of 0.379 gram of Goodyear Vitel PE 100 polyester resin in 8.0 ml of dichloromethane in a 2 oz. amber bottle followed by shaking on a paint-shaker. The dispersion was coated onto a sheet of aluminized mylar having a thickness of 3 mil overcoated with a 0.05 micrometer thick layer of polyester resin (duPont 49,000) with the aid of a 1.0 mil gap Bird-type applicator bar. The applied dispersion was then dried by air-drying followed by drying under vacuum at 100° C. for 2.5 hours. This photoconductive coating was then overcoated with a 20 micrometer charge transport layer containing 40 percent by weight of N,N'-diphenyl-N,N'-bis(3-methylphenyl)-1,1'-biphenyl-4,4'-diamine and 60 percent by weight polycarbonate resin binder (Makrolon) applied by means of a Bird type applicator bar from a dichloromethane solution. The entire device was air dried and dried under vacuum at 100° C. for 2.5 hours.

EXAMPLE XXIX

A photoreceptor device was prepared by repeating the process of Example XXVIII with the exception that the photoconductive pigment dispersion contained 0.349 grams of polyester (PE-100) and that there was added to the dispersion 30.4 mg of d,l-alpha-tocopherol.

EXAMPLE XXX

Testing was carried out to determine the electrical stability of photoreceptor devices prepared with the generator layer sandwiched between the conductive coating and the transport layer when exposed to visible light with and without d,l-alpha-tocopherol. The devices were first tested prior to exposure using a flat-plate scanner with a constant voltage 5.45 KV corotron charging system. The samples were then exposed to a Sylvania F8T5/CWX fluorescent tube in a Thermolyne model LL-6515 fixture with a filter comprised of 20 micrometers of 40 percent by weight N,N'-diphenyl-N,N'-bis(3-methylphenyl)-1,1'-biphenyl-4,4'-diamine in 60 percent by weight polycarbonate resin (Makrolon) coated on 1 mil thick polyester (Mylar) film (as a far UV filter) at a distance of 30 cm. After exposure, the devices were dark-rested for 30 minutes and then retested. Successive exposures and testing were carried out on the same devices. The photoreceptor device without the antioxidant exhibited 4.9% and 13.9% decreases in charge acceptance after 3 minutes and 27 minutes exposures, respectively. The photoreceptor device containing the antioxidant exhibited a decrease of 0.9% and 8.9% in charge acceptance after 3 minutes and 27 minutes of exposure, respectively. This further illustrates the marked improvement in charge acceptance stability achieved when utilizing a antioxidant of this invention in a photgenerating layer of a multilayered photoreceptor.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. An electrophotographic imaging member comprising a conductive layer, a charge transport layer comprising an aromatic amine charge transport or hydrazone molecule in a continuous polymeric binder phase, and a contiguous charge generation layer comprising a photoconductive material, a polymeric binder and from about 0.01 percent by weight to about 20 percent by weight of a hydroxyaromatic antioxidant based on the total weight of said charge generation layer, said hydroxyaromatic antioxidant selected from the group consisting of a hydroxyaromatic compound having the structural formula

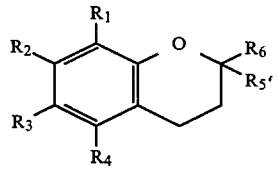

wherein $R_1$, $R_2$, $R_3$, and $R_4$ are independently selected from the group consisting of hydrogen, a hydroxyl group, an alkoxy group containing 1 to 6 carbon atoms, and an alkyl group containing 1 to 6 carbon atoms, wherein at least one of said $R_1$, $R_2$, $R_3$, and $R_4$ is a hydroxyl group, and $R_5$ and $R_6$ are independently selected from the group consisting of hydrogen, an alkenyl group containing 2 to 40 carbon atoms, and an alkyl group containing 1 to 40 carbon atoms, and monomeric or polymeric phenolic compounds having the structural formula

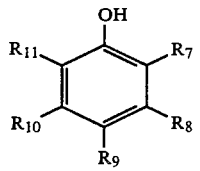

wherein $R_7$, $R_8$, $R_9$, $R_{10}$, and $R_{11}$ are independently selected from the group consisting of hydrogen, a hydroxyl group, a linear alkyl group containing 1 to 20 carbon atoms, a branched alkyl group containing 1 to 20 carbon atoms, an alkenyl group containing 1 to 20 carbon atoms, an ester group containing 1 to 20 carbon atoms, an unsubstituted phenyl group, a substituted phenyl group, a napthyl group, an ester group, and an alkoxy group containing 1 to 20 carbon atoms.

2. An electrophotographic imaging member in accordance with claim 1 wherein said antioxidant is alpha-tocopherol.

3. An electrophotographic imaging member in accordance with claim 1 wherein said antioxidant is selected from the group consisting of tocol, alphatocopherol, beta-tocopherol, gamma-tocopherol, delta-tocopherol, epsilon-tocopherol, zeta$_1$-tocopherol, zeta$_2$-tocopherol, eta-tocopherol and mixtures thereof.

4. An electrophotographic imaging member in accordance with claim 1 wherein said phenolic compound is selected from the group consisting of 2,6-di-tert-butylphenol, 2,6-di-tert-butyl-4-methoxyphenol, 2,6-di-tert-butyl-4-methylphenol, 2-tert-butyl-4-methoxyphenol, hydroquinones, erythrityl tetrakis[beta-(4-hydroxy-3,5-di-tert-butylphenyl)propionate] and mixtures thereof.

5. An electrophotographic imaging member in accordance with claim 1 wherein said antioxidant is selected from the group consisting of unsubstituted napthol compounds and substituted napthol compounds.

6. An electrophotographic imaging member according to claim 1 wherein said charge generation layer comprises from about 0.5 percent by weight to about 5 percent by weight of said hydroxyaromatic antioxidant compound based on the total weight of said charge generation layer.

7. An electrophotographic imaging member according to claim 1 wherein said charge generation layer also comprises a hydroxyalkylcellulose compound, said alkyl being selected from from the group consisting of an ethyl, propyl, butyl, pentyl and hexyl group.

8. An electrophotographic imaging member in accordance with claim 6 wherein said hydroxyalkylcellulose compound is hydroxypropylcellulose.

9. An electrophotographic imaging member in accordance with claim 1 wherein said aromatic amine compound has the general formula:

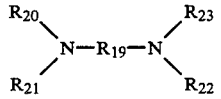

wherein $R_{19}$ is selected from the group consisting of a substituted or unsubstituted phenyl, biphenyl group, diphenyl ether group, alkyl group having from 1 to 18 carbon atoms, and cycloaliphatic group having from 3 to 12 carbon atoms and $R_{20}$, $R_{21}$, $R_{22}$ and $R_{23}$ are an aromatic group selected from the group consisting of substituted or unsubstituted phenyl group, napthyl group and polyphenyl group.

10. An electrophotographic imaging member in accordance with claim 1 wherein said photoconductive material is vanadyl phthalocyanine.

11. An electrophotographic imaging member in accordance with claim 1 wherein said imaging member comprises a protective covercoating layer comprising a selenium alloy.

12. An electrophotographic imaging process comprising providing an electrophotographic imaging member comprising a conductive layer, a charge transport layer comprising an aromatic amine charge transport or hydrazone molecule in a continuous polymeric binder phase and a contiguous charge generation layer comprising a photoconductive material, a polymeric binder and from about 0.01 percent by weight to about 20 percent by weight of a hydroxyaromatic antioxidant based on the total weight of said charge generation layer, said hydroxyaromatic antioxidant selected from the group consisting of a hydroxyaromatic compound having the structural formula

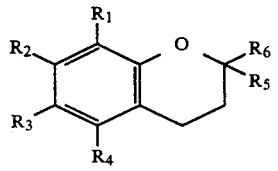

wherein $R_1$, $R_2$, $R_3$, and $R_4$ are indenpendently selected from the group consisting of hydrogen, a hydroxyl group, an alkoxy group containing 1 to 6 carbon atoms, and an alkyl group containing 1 to 6 carbon atoms, wherein at least one of said $R_1$, $R_2$, $R_3$, and $R_4$ is a hydroxyl group, and $R_5$ and $R_6$ are independently selected from the group consisting of hydrogen, an alkenyl group containing 2 to 40 carbon atoms, and an alkyl group containing 1 to 40 carbon atoms, and monomeric or polymeric phenolic compounds having the structural formula

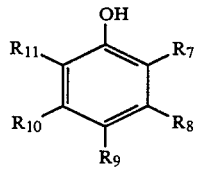

wherein $R_7$, $R_8$, $R_9$, $R_{10}$, and $R_{11}$ are independently selected from the group consisting of hydrogen, a hydroxyl group, a linear alkyl group containing 1 to 20 carbon atoms, a branched alkyl group containing 1 to 20 carbon atoms, an alkenyl group containing 1 to 20 carbon atoms, an ester group containing 1 to 20 carbon atoms, an unsubstituted phenyl group, a substituted phenyl group, a napthyl group, an ester group, and an alkoxy group containing 1 to 20 carbon atoms, uniformly depositing electrostatic charges on said imaging member, exposing said imaging member to activating radiation in image configuration to form an electrostatic latent image on said imaging member, contacting said electrostatic latent image with electrostatically attractable toner particles to form a deposited toner image in image configuration, transfering said toner image to a receiving member, erasing any residual electrostatic charge on said imaging member and repeating said depositing, exposing, contacting, transfering and erasing steps.

13. An electrophotographic imaging process comprising in accordance with claim 12 including intermittently dark resting said imaging member.

* * * * *